United States Patent [19]

Duckworth et al.

[11] Patent Number: 5,010,765

[45] Date of Patent: Apr. 30, 1991

[54] METHOD OF MONITORING CORE SAMPLING DURING BOREHOLE DRILLING

[75] Inventors: Allen Duckworth, Middlefield; Derek Barnes, Wallingford, both of Conn.; Thomas L. Gennings, Anchorage, Ak.

[73] Assignee: Teleco Oilfield Services Inc., Meriden, Conn.

[21] Appl. No.: 398,668

[22] Filed: Aug. 25, 1989

[51] Int. Cl.[5] ..... E21B 49/00

[52] U.S. Cl. ..... 73/153; 73/864.44; 175/40

[58] Field of Search ..... 73/151, 152, 153, 864.44, 73/864.45; 175/40, 44, 27

[56] References Cited

U.S. PATENT DOCUMENTS 4,875,530 10/1989 Frink et al. ..... 175/27

*Primary Examiner*—John Chapman
*Assistant Examiner*—Kevin D. O'Shea
*Attorney, Agent, or Firm*—Fishman, Dionne & Cantor

[57] ABSTRACT

Downhole measurements are made for accurately determining whether or not a core barrel contains an appropriate amount of core sample before retrieval of the coring tool is attempted. This is accomplished by using a known apparatus for measuring downhole weight on bit (WOB) at the beginning of a coring run to make a first measurement corresponding to the weight of all drillstring components suspended below the measurement point at a selected depth. Thereafter, the coring tool drills down the length of the core barrel. When sufficient drilling takes place to obtain a core, the drillstring is pulled up to the same depth as the measurement and a second measurement is taken. After correcting the data for temperature changes, the difference in between the first and second measurements is obtained and compared to a calculated weight for a full core. If the difference in measurements is less than the calculated full core weight, then it is known that a full core has not been obtained and the coring operation is continued. However, if the difference in the measurements does correspond to the calculated weight of a full core barrel, then the drillstring is retrieved and the acquired core sample is obtained.

6 Claims, 1 Drawing Sheet

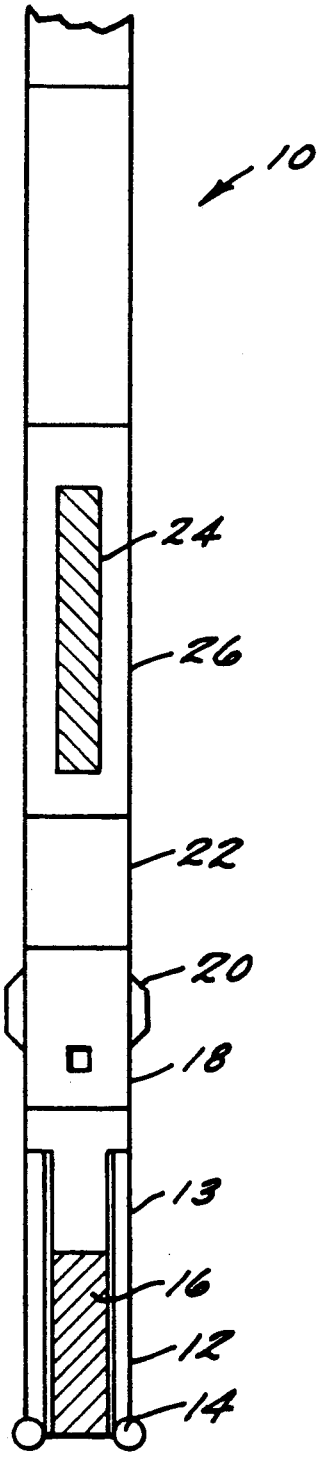
10
24
26
22
20
18
13
16
12
14

METHOD OF MONITORING CORE SAMPLING DURING BOREHOLE DRILLING

BACKGROUND OF THE INVENTION

This invention relates to the field of borehole measurements. More particularly, this invention relates to a method of monitoring the core sampling process of a downhole core acquisition tool so as to detect the presence of an adequate core sample prior to retrieving the core barrel to the surface.

In various downhole drilling operations, it is often necessary to obtain core samples of the strata being drilled. Such core samples are acquired by use of known coring tools which are attached at the end of the drillstring and act to retrieve a cylindrical core sample. However, when drilling a sample core, it is often difficult to determine when the core barrel of the coring tool is full of core and whether or not the core is properly retained in the coring tool. If the drilling personnel on the surface makes an incorrect judgement regarding the status of the core, and thereafter remove (i.e., trip) the drillstring from the hole without receiving sufficient core, then the coring operation must be repeated leading to a substantial waste of rig time and therefore higher drilling costs. It will be appreciated that premature removal of the coring tool prior to acquiring a full core is a fairly frequent and highly undesirable occurrence at a typical drilling site.

SUMMARY OF THE INVENTION

The above-discussed and other drawbacks and deficiencies of the prior art are overcome or alleviated by the novel method of the present invention wherein certain downhole measurements are made for accurately determining whether or not a core barrel contains an appropriate amount of core sample before retrieval of the coring tool is attempted. In accordance with the present invention, a known apparatus for measuring downhole weight on bit (WOB) is utilized at the beginning of a coring run to make a first reading which is actually a measurement of the suspended weight of all drillstring components below the measurement point, at a selected depth. Thereafter, the coring tool drills down the length of the core barrel. When sufficient drilling takes place to obtain a core, the drillstring is pulled up to the same depth as the first measurement and a second measurement reading is taken. After correcting the data for temperature changes, the difference in measured weights is obtained and compared to a calculated weight for a full core barrel. If the difference in measured weights is less than the calculated full core weight, then it is known that a full core has not been obtained and the coring operation is continued. However, if the difference in weights does correspond to the calculated weight of a full core barrel, then the drillstring is retrieved and the acquired core sample is obtained.

The apparatus for measuring weight-on-bit is preferably of the type disclosed in U.S. Pat. No. 4,821,563 or U.S. application Ser. No. 390,155, entitled "Apparatus for Measuring Weight, Torque and Side Force on a Drill Bit" filed Aug. 7, 1989, both of which are assigned to the assignee hereof and fully incorporated herein by reference. The several measurements obtained by the WOB measuring apparatus are delivered to the surface using a suitable downhole telemetry method which preferably comprises of known measurement-while-drilling mud pulse telemetry systems such as are described in U.S. Pat. Nos. 3,982,431, 4,013,945 and 4,021,774 assigned to the assignee hereof.

The method of the present invention thus monitors the core sampling process so that the driller receives a good indication that a full core has been cut and properly retained in the coring tool before the coring assembly is returned to the surface. By using the procedure of the present invention, the wasted time and expense of retrieving an empty core barrel is avoided.

The above discussed and other features and advantages of the present invention will be appreciated and understood by those skilled in the art from the following detailed description and drawings.

BRIEF DESCRIPTION OF THE DRAWINGS

The single FIGURE schematically depicts the drillstring subs at or near the bottom of a drillstring.

DESCRIPTION OF THE PREFERRED EMBODIMENT

Referring to the FIGURE, the bottom portion of a drillstring is shown generally at 10. At the bottom of drillstring 10 is a known and commercially available coring tool 12 having a core barrel 13 which is associated with a hollow drill bit 14 and is adapted to drill a core sample 16 in a known manner. Immediately above coring tool 12 is a measuring sub 18 which houses the weight-on-bit and torque-on-bit measuring apparatus used in the method of the present invention. If desired, a near bit stabilizer 20 may be mounted on sub 18. The top of measuring sub 18 is connected to an intermediate sub 22 which may house other measurement-while-drilling (MWD) sensors, such as directional sensors, and an instrument package 24 including electronics for use with the WOB measuring apparatus of sub 18 and other such sensors. Intermediate sub 22 is connected at its top to an MWD transmitter sub 26 which may house, e.g., a mud pulse transmitter for transmitting downhole measurements including WOB measurements obtained using the sensor package of sub 18, to the surface without the need for electrical cables.

The measuring apparatus contained in measuring sub 18 preferably comprises the weight-on-bit instrumentation disclosed in U.S. Pat. No. 4,821,563 (or U.S. application Ser. No. 390,155 filed Aug. 7, 1989) the entire disclosures of which have been incorporated herein by reference. Thus, sub 18 is analogous to the sub identified at 10 in FIG. 1 of U.S. Pat. No. 4,821,563 and comprises a plurality of strain gages which are located in radial througholes (or partial holes) in the wall of a drill collar sub for measuring each of the parameters of weight, torque and bending. The holes are sealed by plugs. To minimize errors in the WOB measurement due to pressure differentials across the sub wall, the strain gages in the WOB bridge are mounted in a precise and novel array so that the WOB bridge output is insensitive to strains caused by pressure differentials across the sub wall. Thus, sub 18 provides extremely precise and reliable measurements which are required in performing the method of the present invention.

After any interruption during normal drilling operations, it is known to pull the drill bit off the bottom of the hole so that data maybe telemetered to the surface regarding absolute values of weight and torque as measured by the downhole sensor 18. These absolute values are referred to as tare data. When normal drilling is resumed, the difference between the tare data and the data obtained while drilling ahead represent the actual net weight and torque applied to the bit. This information is important and used to analyze drilling rate data such as rate of penetration, rate of bit wear and direction of drilling.

In accordance with the method of the present invention, a conventional tare weight reading as described above is used. In other words, the WOB measuring apparatus of U.S. Pat. No. 4,821,563 may be raised off the bottom of the hole and a reading taken from the apparatus will correspond to the freely suspended weight of all drillstring components below the measurement point. As is clear from the FIGURE, this weight will correspond primarily to the weight of the core acquisition apparatus. Thus, in the present invention, at the beginning of a coring run, a first weight measurement is made (i.e., with the bit off-bottom). The exact depth at which this first measurement is made is carefully recorded. Preferably, this depth is preselected by marking the Kelly or drill pipe at the surface.

After this first measurement reading is taken, drilling begins to acquire the core. While drilling the core, weight-on-bit and torque-on-bit are monitored in the normal fashion. These measurements can and will be used to improve actual coring operations as successful coring depends in some measure on maintaining predetermined WOB and ROP. When the bit has penetrated a distance corresponding to the length of the core barrel, the drillstring is pulled up to exactly the same borehole depth which corresponds to the position where the first measurement was taken. At this point, a second measurement reading is taken. If the difference between the first and second measurements corresponds approximately to the calculated weight of a full core, then the drillstring may be retrieved (e.g., tripped) from the hole with a high confidence that the core has been properly acquired and retained. If this correspondence between the initial and final readings is not obtained, then the core barrel does not contain an appropriate amount of core sample. At this point, the driller may elect to drill further in another attempt to fill the core barrel.

Returning the drillstring to the same depth for both first and second measurements is an important feature of the present invention. This is because the "flotation pressure" exerted, by the borehole fluids will effect the weight measurements. Moreover, as this pressure variation varies with depth, restoration of the exact depth for the second measurement is extremely important in accurately determining whether or not the core has been properly acquired and retained.

In an effort to further improve the accuracy of the several measurements, it may be necessary to correct the data for changes in downhole temperature between the first and second measurements. This may be accomplished by measuring and transmitting the temperature at the exact location where the weight measurement is made.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of monitoring the acquisition of a core sample obtained from a coring tool on a drillstring in a borehole, comprising the steps of:

measuring the weight of a portion of the drillstring at a pre-selected borehole depth when the drillstring is off bottom to define a first measurement;

drilling to acquire a core sample; measuring the weight of a portion of the drillstring at a pre-selected borehole depth when the drillstring is off-bottom to define a second measurement;

determining the difference between the first and second measurements, the difference corresponding to the weight of the core sample; and comparing the measured core sample weight to a calculated weight of a full core sample to determine if the core sample has been acquired.

2. The method of claim 1 wherein:

said first and second measurements are taken at about the same borehole depth.

3. The method of claim 1 including the steps of:

measuring the temperature during the first measurement;

measuring the temperature during the second measurement; and correcting the first and second measurements for temperature differences.

4. The method of claim 1 including the step of:

monitoring weight-on-bit during drilling of the core sample.

5. The method of claim 1 wherein the drilling step comprises:

drilling the length of the core sample.

6. The method of claim 1 wherein the weight measurements are taken using a weight measurement tool and wherein said portion of the drillstring comprises:

drilling components suspended below said weight measurement tool.

* * * * *

UNITED STATES PATENT AND TRADEMARK OFFICE

CERTIFICATE OF CORRECTION

PATENT NO. : 5,010,765

DATED : April 30, 1991

INVENTOR(S) : Allen Duckworth et al

It is certified that error appears in the above-identified patent and that said Letters Patent is hereby corrected as shown below:

Title Page:

In the Abstract, line 12, between "the" and "measurement" add --initial--.

In the Abstract, line 14, delete "in".

In the Abstract, line 20, change "the measurements" to --measurements-- .

Column 1, line 51, delete "barrel".
Column 2, line 47, after ")", insert --,--.
Column 3, line 32, change "depth which" to --position which--.
Column 3, line 32, change "position where" to --depth where--.
Column 3, line 47, delete "," after "exerted".

Signed and Sealed this

Fourth Day of May, 1993

*Attest:*

Michael K. Kirk

MICHAEL K. KIRK

*Attesting Officer*

*Acting Commissioner of Patents and Trademarks*